United States Patent [19]

Conly et al.

[11] Patent Number: 4,490,032

[45] Date of Patent: Dec. 25, 1984

[54] MODULATED LIGHT PRINTING

[75] Inventors: Douglas J. Conly; Bonnie B. Baker; David D. Larson, all of Boulder, Colo.; Stanley T. Riddle, Tucson, Ariz.

[73] Assignee: International Business Machines Corporation, Armonk, N.Y.

[21] Appl. No.: 388,570

[22] Filed: Jun. 14, 1982

Related U.S. Application Data

[63] Continuation of Ser. No. 146,714, May 5, 1980, abandoned.

[51] Int. Cl.[3] ..... G03G 15/04

[52] U.S. Cl. ..... 355/14 R; 355/3 R; 358/300

[58] Field of Search ..... 358/300, 901; 355/3 R, 355/1, 7, 14 R; 354/4, 5, 6

[56] References Cited

U.S. PATENT DOCUMENTS

| | | | |
|---|---|---|---|
| 3,464,330 | 9/1969 | Lewis | 354/4 |
| 3,581,102 | 5/1971 | Nagao | 355/1 X |
| 3,832,488 | 8/1974 | Fahey et al. | 354/7 X |
| 3,836,917 | 9/1974 | Mee | 354/7 X |
| 3,877,799 | 4/1975 | O'Donnell | 355/40 X |
| 3,952,311 | 4/1976 | Lapeyre | 354/4 X |
| 3,987,467 | 10/1976 | Cowles | 355/40 X |
| 4,008,954 | 2/1977 | Ogawa et al. | 355/3 R X |
| 4,090,206 | 5/1978 | Pfeifer et al. | 354/4 X |
| 4,096,486 | 6/1978 | Pfeifer et al. | 354/4 X |
| 4,107,687 | 8/1978 | Pfeifer et al. | 354/5 X |
| 4,229,086 | 10/1980 | Beery et al. | 354/5 |
| 4,255,042 | 3/1981 | Armitage et al. | 355/3 R |

OTHER PUBLICATIONS

Harris, T. J.; "Optical Printer"; IBM Technical Disclosure Bulletin; vol. 13, No. 12, May 1971; pp. 3757 and 3758.

*Primary Examiner*—Fred L. Braun

*Attorney, Agent, or Firm*—Francis A. Sirr; Carl M. Wright

[57] ABSTRACT

Modulation of the edge erase lamps in a copier/duplicator/printer to record visual data in the normally unused margins of a copy/duplicate/print. Numerical information can be recorded by a controlled switching sequence of the lamps normally used for edge erasing on electrophotostatic type copiers (or duplicators or printers). Turning off an edge erase lamp causes a dark streak near the margin on the copy in line with the lamp so switched off. By selectively turning off and on combinations of a plurality of edge erase lamps, visual data such as numerals can be written in the margins while copies (or duplicates or prints) are being produced.

3 Claims, 11 Drawing Figures

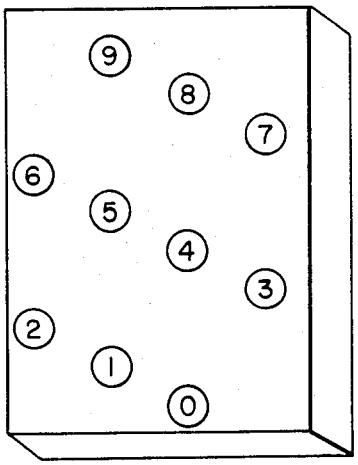
FIG. 1
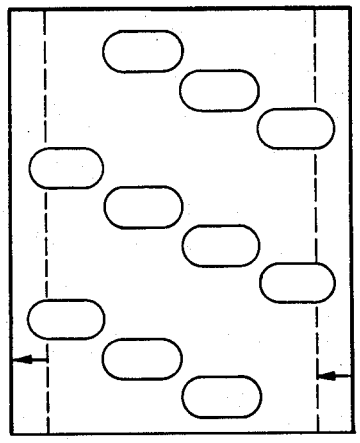
FIG. 2
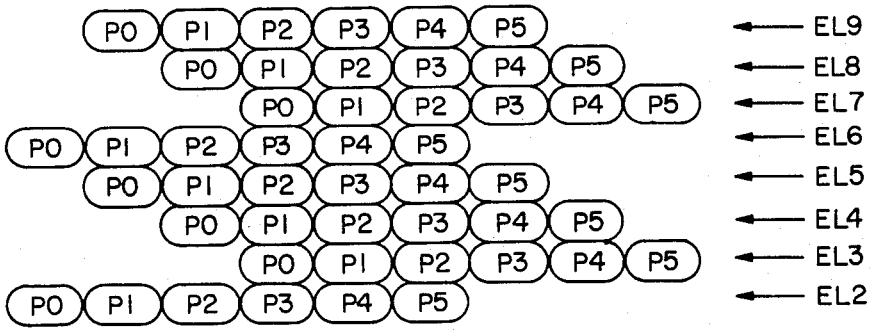
FIG. 3
| | | | |
|---|---|---|---|
| P2 | P3 | P4 | EL9 |
| P1 | P2 | P3 | EL8 |
| P0 | P1 | P2 | EL7 |
| P3 | P4 | P5 | EL6 |
| P2 | P3 | P4 | EL5 |
FIG. 4
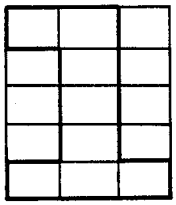
FIG. 5
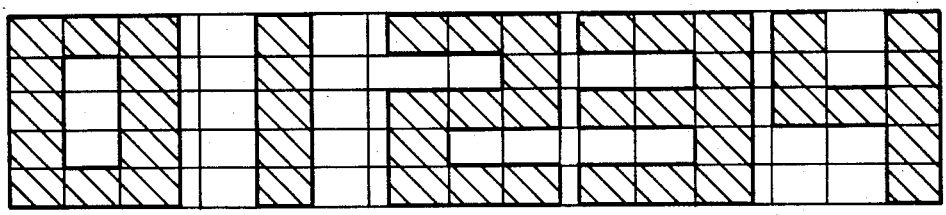
FIG. 6

MODULATED LIGHT PRINTING

This is a continuation of application Ser. No. 146,714 filed on May 5, 1980, now abandoned.

DOCUMENTS INCORPORATED BY REFERENCE

U.S. Pat. No. 4,170,414 (Hubert et al.) assigned to the same assignee as this application; hereinafter referred to as Ref. 414.

TECHNICAL FIELD

This invention relates to the formation of characters by a source onto a medium which are moving relative to one another by modulating a light source and, particularly, to the use of modulated light emitting diodes onto the photoconductive surface of a copier drum.

BACKGROUND ART

Copiers and printers which use laser character generators have the ability to generate images in response to input electrical signals as contrasted to the copying of an original document by photo-optical means. Light scanning may be used to generate characters but is less efficient than laser type printing, both of which are expensive and require expensive apparatus.

In a copier without such scanning apparatus, it is often desirable to be able to produce output copies of information originating within the machines. Such information includes the number of total hours of machine operation, the total number of copies (which can be divided into those made from different sources such as a semiautomatic document feeder and an automatic document feeder), the total number of paper jams, and the like. This data is collected during operation by the control portion of the copier. A line of LED's to form characters may be used as shown in the IBM TECHNICAL DISCLOSURE BULLETIN, Volume 13, Number 12, May, 1971, pages 3757–3758. This arrangement, however, requires a large number of light emitting diodes as well as extensive logic and control for driving the diodes.

Some copiers are equipped with variable edge erasing lamps for providing erasure at the edges of a copy depending on the size of the copy being made. This invention teaches and discloses how the variable edge light emitting diode erasing lamps can be used to generate readable characters on copy pages.

Photoreceptor charge devices on copier apparatus can also be used for generating characters. U.S. Pat. Nos. 4,082,450 and 4,082,451 illustrate the use of charge distribution devices for structuring dot or line patterns. These patents, however, do not teach the use of such devices for printing characters.

DISCLOSURE OF THE INVENTION

In accordance with the invention, a source means is provided with a plurality of selectively modulated energy sources and a medium means, receptive of the energy from the source means, produces a visual manifestation of the energy, where the source means and the medium means are in motion relative to one another. There is also provided a means for modulating each one of the said plurality of energy sources to produce readable characters on the medium means.

BRIEF DESCRIPTION OF THE DRAWING

FIG. 1 is a diagram of a diode block containing ten light emitting diodes.

FIG. 2 is a drawing representing the result of relative motion of the diode block depicted in FIG. 1.

FIG. 3 is a schematic representation of the successive positions of the edge erase lamps two through nine during the generation of a character.

FIG. 4 is a chart representing the position of five lamps for producing a preferred character font.

FIG. 5 is a representation of a character "one" produced by the five edge lamps in three successive positions.

FIG. 6 is an illustration of the preferred font of the digits zero through four.

DESCRIPTION OF THE PREFERRED EMBODIMENT

In FIG. 1, ten light emitting diodes are arranged to provide slightly overlapping bands of light on a moving photoconductor. The relative motion of the photoconductor beneath the photoconductor block of FIG. 1 with the lights on produces a series of light band segments which are illustrated in FIG. 2. The length of the bands of light in FIG. 2 depends on the period of time the light emitting diodes are energized. Energizing the LED's for successive time periods produces bands of controllable lengths.

In FIG. 3, a series of light bands for the edge lamps two through nine is shown in successive positions P0 through P5 where each position corresponds to a time period of activation. Although alpha-numeric and special characters can be generated, the explanation of the invention will be limited to the display of the digits zero through nine.

The font used to display the digits comprises five rows using the edge lamps five through nine in the three successive positions illustrated in FIG. 4. A digital character one, illustrated in FIG. 5, can be generated by activating the edge lamps five through nine in various positions. For example, the digit one shown in FIG. 5 is generated by activating edge lamp nine in positions two and three, edge lamp eight in position two, edge lamp seven in position one, edge lamp six in position four, and edge lamp five in positions two through four.

Figure 7:
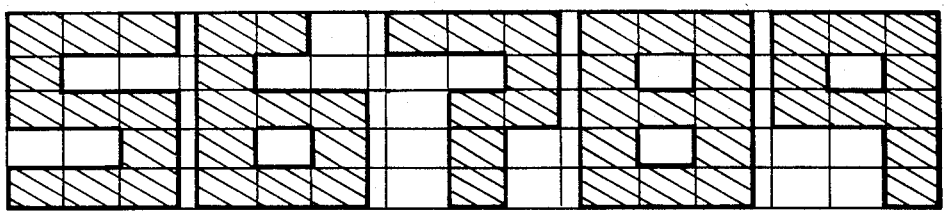
FIG. 7 is an illustration of the preferred fonts of the digits five through nine.

FIGS. 6 and 7 illustrate how the characters from zero through nine can be formed in an analogous way.

Figure 8:
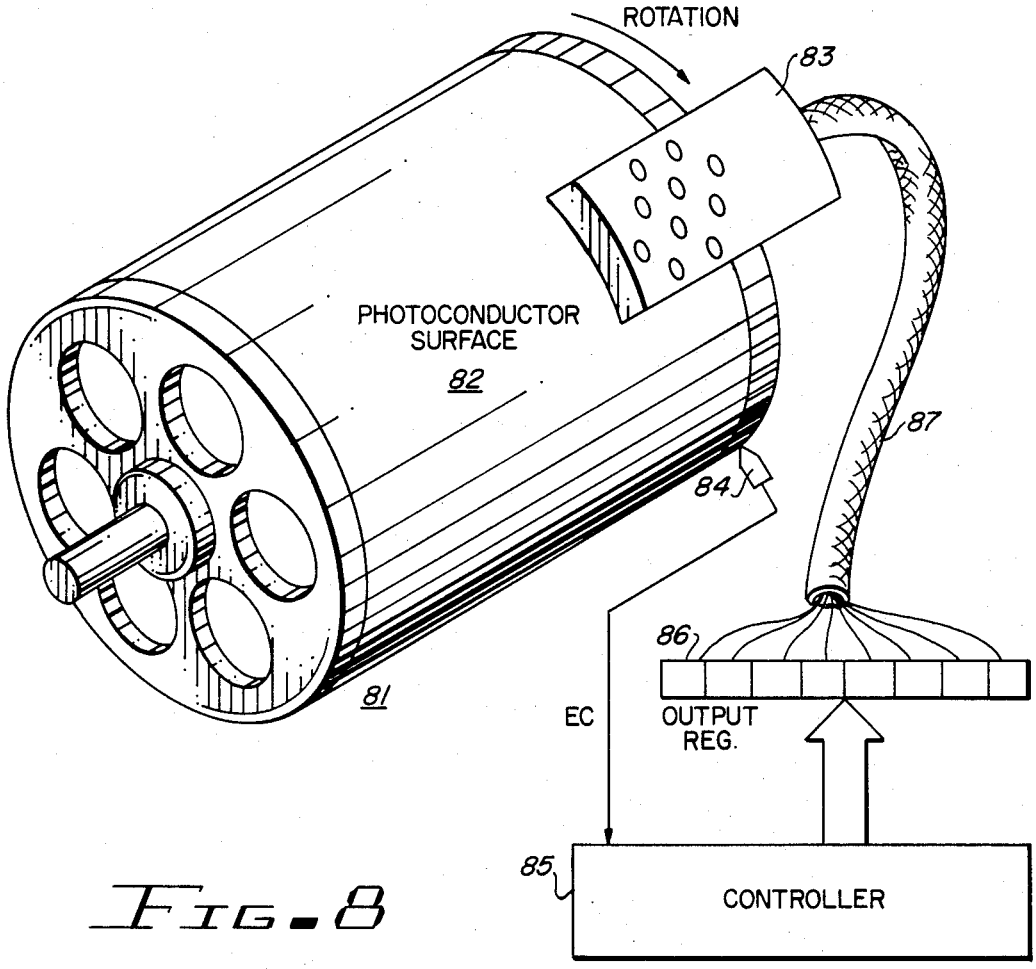
FIG. 8 is a pictorial illustration of one embodiment of the invention.

In FIG. 8, a copy drum 81 includes a photo-conductive surface 82. Mounted adjacent to the photoconductive surface, but not touching it, is a diode block 83, shown as including ten diode positions. These correspond to the positions shown in FIG. 1. Only those numbered five through nine are to be used for generating the digits as will be explained in detail.

A sensor 84 is used to supply emit count signals to a controller 85 for determining the position of the photoconductive surface 82. The controller 85 supplies output signals which set various bits in an output register 86 which are coupled by a cable 87 to the individual light emitting diodes in the block 83. When a particular bit in the output register 86 is set, the corresponding connected LED in the block 83 is lighted. When the bit is reset in the output register 86, the corresponding LED is dark.

Figure 9:
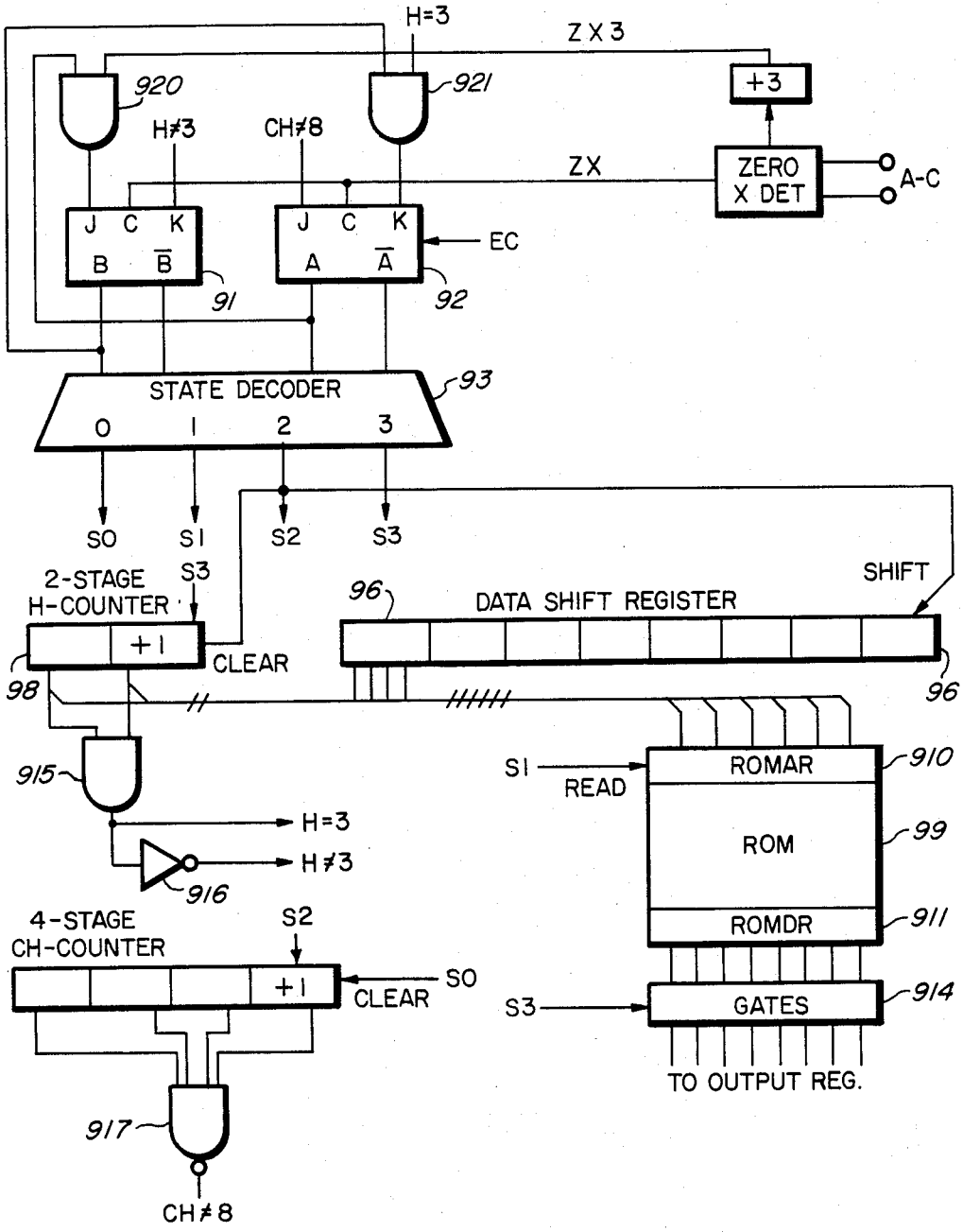
FIG. 9 is a controller useful in the system illustrated in FIG. 8.
Figure 10:
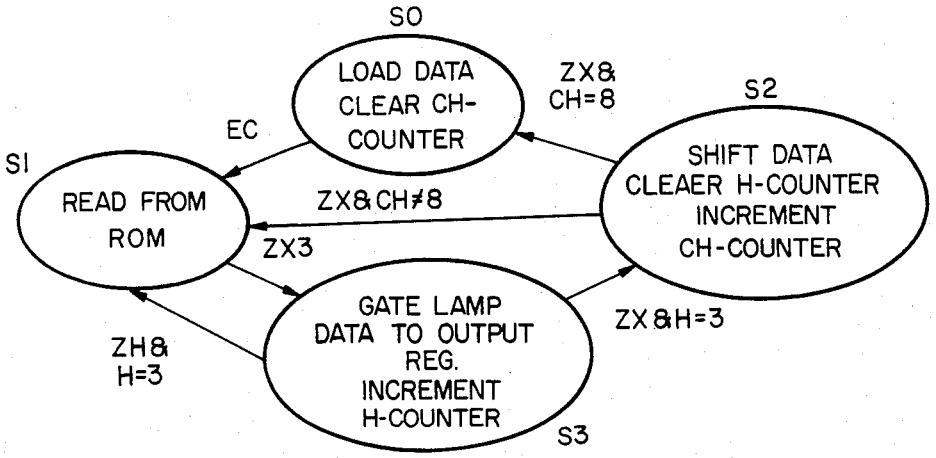
FIG. 10 is a state diagram representing the operation of the controller in FIG. 9.

FIG. 9 illustrates a controller which can be used in the system illustrated in FIG. 8. The explanation of the operation of FIG. 9 can be more easily understood with the aid of the state diagram of FIG. 10. Two clocked J-K flip-flops 91 and 92 form the state control portion of the controller. The states are numbered zero through three, corresponding to the binary values in the flip-flops 91 and 92 and decoded by a decoder 93. The timing control is provided by a zero-crossing detector 94 which is coupled to the a-c power line and provides an output signal ZX each time the alternating current input power voltage has a zero value. Such zero-crossing detectors are well known in the art and need no further explanation for an understanding of the invention.

The timing signal ZX is also applied to a divide-by-three circuit 95 which produces a control signal ZX3 which occurs every third zero-crossing of the input power.

It is assumed that the initial controller state is zero during which time the data to be printed is loaded into a data shift register 96 by a means not shown but which is well known in the art. During state zero, a four-stage character counter 97 is cleared.

Also provided is a two-stage H-counter 98 which provides part of the character address as will be explained in greater detail below. A Read-Only Memory 99 (ROM) is also supplied. The ROM has a memory address register 910 and a data register 911. Table I illustrates the ROM data to produce the font of FIGS. 6 and 7 using five in-line LED's for simplicity of explanation rather than the offset LED's as shown in the block 83 (FIG. 8).

The ROM address is a combination or concatenation of two bits of the two-stage H-counter 98 and the four bits of the binary coded decimal digit being displayed which is in the left-hand stage 961 of the data shift register 96. The output data comprises eight bits, the first five corresponding to the five diodes to be controlled, the least significant three bits being zero and not used.

The output data from the data register 911 is gated to the output register 86 (FIG. 8) by a network of AND gates 914 which is enabled by the state three (S3) signal from the decoder 93.

The three columns of the font are identified by the first three values of the two-stage H-counter 98, viz., 00, 01, and 10. When the two-stage H-counter reaches a value of three, the character in the shift register stage 961 has been printed. The value of three in the H-counter 98 is detected by an AND gate 915 which produces a signal H=3 and an inverter 916 supplies the signal H≠3.

It is assumed that each copy sheet to be printed will contain eight characters. These are counted by the CH-counter 97. A NAND gate 917 provides an output signal indicating that the character count is not equal to eight.

In the operation of the controller, the output gates 914 are enabled at every third zero-crossing of the power, i.e., every S3 state. Each of the columns, therefore, has a width equal to the linear travel of the photoconductor in a period equal to three zero-crossings, i.e., 1/20-th of a second.

The detailed operation of the controller is as follows. The EC signal, which indicates that the drum is in proper position to begin forming the characters, sets the flip-flop 92 causing the controller to enter state one. During state one, the information is read from the ROM at the address determined by the H-counter bits and the BCD character bits of the character in the stage 961. With the flip-flop 92 set, the ZX3 signal activates an AND gate 920 which causes the ZX signal to set the flip-flop 92. The CH≠8 signal from the NAND gate 917 is high so that the flip-flop 92 remains in the set state. This causes the controller to enter state three which gates the data register 911 to the output register via the gates 914. Also, the state three signal increments the H-counter 98 by one. At the next zero-crossing, the machine returns to state one if the H-counter has not reached the value of three. This is caused by the ZX signal clocking the J-K flip-flop 91 with only the K input (H≠3) signal high. Initially, the first two ROM address bits are 00 and the other four bits are the BCD equivalent of the character being written. Therefore, at the next ZX3 time, the BCD digits of the address are the same but the H-counter now has a value of 01 so that the second column of the data controlling the digit are accessed from the ROM and at state three are gated to the output register. This sequence continues until after the third column is printed and the H-counter is incremented to a value of three.

When H=3, the next zero-crossing causes the controller to enter state two, caused by clocking the flip-flop 92 with both inputs high, the K input signal being the high output signal from the AND gate 921.

In state two, the data register 96 is shifted to place the next digit in state 961 and the H-counter 98 is cleared to zero. Also, the CH-counter 97 is incremented by one. With the CH≠8, the next zero-crossing causes the machine to enter state one where the above sequence is repeated for the second digit.

The above-described operation is repeated until all eight characters have been printed at which time the low signal from the NAND gate 917 at the J input of the flip-flop 92 causes the flip-flop 92 to be reset and the controller assumes the original state zero.

Hardware controllers such as that just described have many disadvantages. For example, it is difficult to design an efficient hardwire controller, i.e., one that uses a minimum number of gates and prevents interstate transients. Also, such hardwired controllers are difficult to modify to perform a new function once the design is completed. The efficient design increases in difficulty as the number of required states increases so that, even with computer-aided design, controllers are expensive and time consuming to design. The microprocessor has provided a viable alternative to the design of large sequential control machines. Replacing the hardware design with a logic flow design, i.e., a program, provides a level and scope of control not readily attainable with hardwired controllers. The sequence of operations in a microprocessor-based controller is determined by control signals in the form of a program rather than decoding logic dependent on feedback and input variables.

It is preferable, therefore, to execute the functions using a programmed microprocessor which provides the same functions as a hardwired controller but requires only programming and the peripheral hardware to perform the complicated actions of a complex controller. The following description discloses an embodiment which can be programmed on a microprocessor.

Microprocessors are well known in the art and commercially available. The following description and flowcharts can be applied to any of the available microprocessors. Appendix B hereto describes the conventions employed in the flowcharts (Charts I to III). The numbers in the right-hand column identify the hexadecimal address of the first instruction in the attached programs related to the associated step. The attached programs can be used on a microprocessor such as that described in Ref. 414, incorporated herein by reference. Appendix A summarizes the relevant instructions.

The program for controlling a copier must perform many tasks in addition to the program being described. Therefore, certain portions of the invention may be found in separate routines. In one embodiment, a STARTOUT routine is used to begin the data output according to the invention. This is flowcharted in Chart I and is used to initialize the data output before printing. The STARTOUT routine performs several functions. It loads the contents of the next register to be displayed into OUTDATA1 (low order byte) and OUTDATA2 (high order byte) registers. These correspond to the data shift register 96 (FIG. 9). The data is left-justified to suppress leading zeros and an output character count (CHARCNT) is appropriately incremented to insure that the output of only valid (justified) data. The output control counter is initialized to a value of −1 and the current character (CURRCHAR) and last character (LASTCHAR) registers are loaded with an address to insure that a null output precedes the data. The STARTOUT routine is called by a CZCOUNT routine, a pseudo-emitter routine which is used to control the timing. As shown in Chart I, the STARTOUT routine sets the OUTPTNOW bit at line 2. This bit is used to indicate to another routine (LEDWRITE) that the data is ready for printing. Next, the OUTFETCH subroutine is called. This subroutine fetches and converts the register content to be displayed. It loads the contents from a selected register whose value is expressed in binary and converts it to eight binary coded decimal digits for data output. (OUTFETCH is flowcharted in Chart II below.)

At line 4, the output mode counters are initialized by clearing CHARCNT to zero and setting OUTCOUNT to −1. Next, a loop is performed while CHARCNT≠8 and the high order digit is equal to zero. The zero is shifted out and the CHARCNT is incremented by one. If an odd-number character is in the high order digit, the program transfers to line 11. Otherwise, as shown at step 9, all the lower digits are shifted two places to the left and the loop repeated. After this is completed, i.e., CHARCNT=8 or the high order digit is not a zero, the subroutine returns to the calling routine.

In Chart II, the OUTFETCH routine is detailed. First, the address of the next register to be written is fetched. The DIVIDE routine is called which divides the register value by 10,000. This, in effect, splits the register into two four decimal digit values. Next, the subroutine BINBCD is called to convert the high order digits to be BCD. Conversion of binary to BCD is well known in the art and need not be explained for an understanding of the invention. Next, the binary coded digits are stored in the high output register OUTDATA2, and the BINBCD subroutine is called to convert the lower order digits to BCD which are then stored in the low output register OUTDATA1.

The LEDWRITE routine (Chart III) is used to write the data onto the photoconductor using the variable edge erase lamps. The written image is then developed and transferred to a copy sheet as is well known in the art. The following steps have already been done by the STARTOUT routine before calling the LEDWRITE routine. The data to be printed is stored in the OUTDATA registers in BCD format, the number of trailing digits, i.e., those to be skipped because of zero suppression, is stored in CHARCNT, and an address eleven bytes before the first null character address in the output table has been loaded into the CURRCHAR and LASTCHAR registers. (This address is symbolically indicated as CHARNPO-11.) The output control counter, OUTCOUNT, has been set to −1. The OUTPTNOW bit is tested (step 2) and, if not set, the program branches to step 17 which ends (exits) the routine. Otherwise, the routine goes to step four where it is determined whether it is time to change the output. If the output is not to be changed, the current output pattern is written and the routine ends. The output is changed at every third zero-crossing as signified by a bit which is supplied by another program before the LEDWRITE routine is called. If it is time to change the output, the output change counter is reset and the position counter is incremented by one. A test is made to determine whether the position counter indicates position four. If not, the pointer is changed to the next output state and the LASTCHAR address is tested to determine whether it is beyond the end of the font table. If not, the last character bit pattern is loaded and the current character and last character bits are combined. This will be explained below in more detail. At the step 14, the lamps not to be written are turned off and the lights to be written will be turned on at the next zero-crossing. Next, the character count is checked. If equal to ten, the OUTPTNOW bit is reset and the routine ends. If the character count is not equal to ten, the routine ends and will be resumed on the next zero-crossing. At step nine, if position four was sensed, the counter is returned to position zero and the current table address is moved to the last table address, the character count is incremented by one, and it is determined whether the last character has been written. If so, the CHARNPO (null character) is moved to the current character.

Because the LED's are offset, some of the next character positions will be encountered before the last character positions of the current character so the bits of the current character and last character are combined. This is done by shifting the last character to the left and ORing the bits of the next character into the resulting low order zero bits.

Table II below represents a font table useful for the offset LED writing where the location of the first character of position zero begins at the hexadecimal address F7B8. The contents of the memory are indicated in hexadecimal characters.

Figure 11:
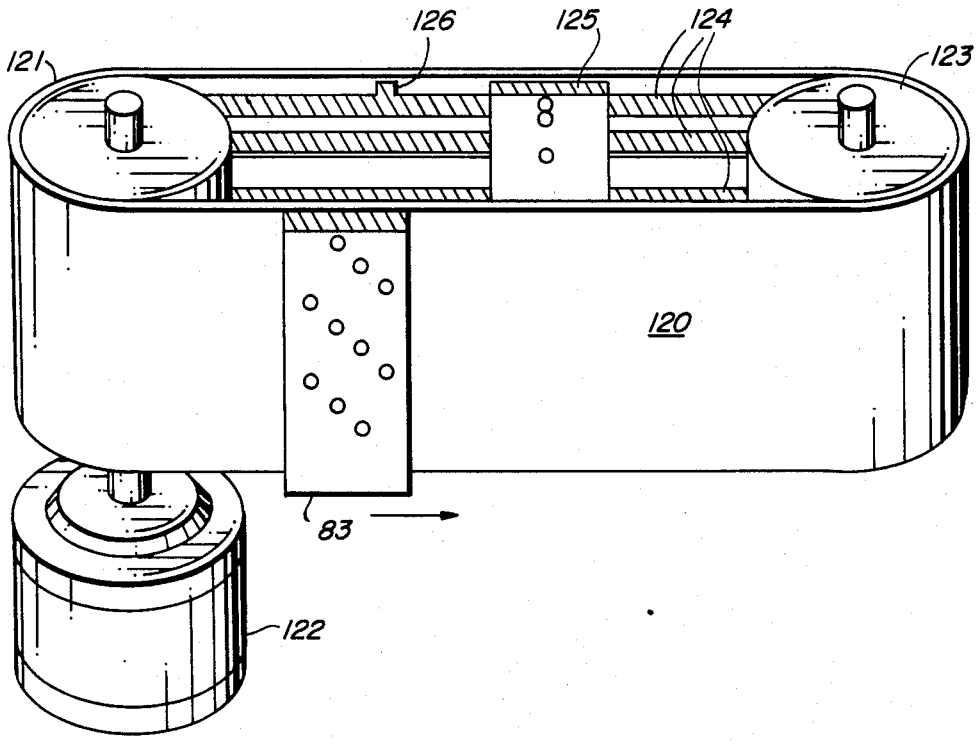
FIG. 11 is an illustration of another useful embodiment of the invention.

The invention may also be used for forming readable characters using the retinal retentivity of the eye as the medium. In FIG. 11, a diode block 83 is mounted on a belt 120 which is driven by a drive roller 121, powered by a motor 122. The belt 120 is maintained by a tension roller 123. Both the drive roller 121 and the tension roller 123 have non-conductive surfaces.

Power to the light emitting diodes in the block 83 is supplied by connections through the belt 120 to conductive bands 124 running around the inside surface of the belt. A brush block 125, coupled to the controller (not shown in FIG. 11), transfers power to the conductive bands 124.

Time synchronization, i.e., signal EC to the controller, is provided by a protrusion 126 on the common line which shorts out the top two brushes on the brush block 125.

As the diode block 83 is driven from left to right from the viewer's aspect, the diodes are modulated as described above to produce the characters. The speed of movement and modulation period can be adjusted so that the viewer sees the characters being produced because of the tendency of the human eye to retain visions of light on the optic nerve for short periods of time.

A second block can be mounted on the opposite side of the belt so that the second block comes into view on the left as the first block disappears to the right. This provides better continuity of vision.

CHART I: STARTOUT ROUTINE

| | | |
|---|---|---|
| 1. | enter | |
| 2. | set OUTPTNOW bit | EF78 |
| 3. | call OUTFETCH | EF7E |
| 4. | initialize output mode counters | |
| 4a. | clear CHAR.CNT to zero | EF83 |
| 4b. | set OUTCOUNT to −1 | EF85 |
| 5. | WHILE CHAR≠8 & HIGHORDER DIGIT=0 | |
| 6. | shift LEADING ZERO out | EF92 |
| 7. | increment CHAR.CNT by 1 | EF98 |
| 8. | ODD NUMBERED CHAR.? (11) | EF99 |
| 9. | shift ALL LOWER DIGIT TWO PLACES left | EF9C |
| 10. | LOOP | |
| 11. | load TRAILING NULL CHAR. into CURR. and LASTCHAR registers | EFA3 |
| 12. | return | EFAC |

CHART II: OUTFETCH ROUTINE

| | | |
|---|---|---|
| 1. | enter | |
| 2. | fetch ADDR. of NEXT REGISTER to be OUTPUT | EFAD |
| 3. | call DIVIDE (divide register by 10,000) | EFC9 |
| 4. | call BINBCD (convert high order digits to BCD) | EFD1 |
| 5. | store DIGITS in HIGH OUTPUT register (OUTDATA2) | EFD4 |
| 6. | call BINBCD (convert low order digits to BCD) | EFDA |
| 7. | store digits in LOW OUTPUT register (OUTDATA1) | EFDD |
| 8. | return | EFE2 |

CHART III: LEDWRITE ROUTINE

| | | |
|---|---|---|
| 1. | begin | |
| 2. | OUTPTNOW bit set ? (4) | D4EA |
| 3. | (17) | D4EE |
| 4. | TIME TO CHANGE OUTPUT ? (7) | D4FO |
| 5. | write CURR. OUTPUT PATTERN | D568 |
| 6. | (17) | |
| 7. | reset OUTPUT CHANGE COUNTER | D4F5 |
| 8. | increment POSIT. COUNTER by 1 | |
| 9. | POSITION 4 ? (18) | D4F7 |
| 10. | point to NEXT OUTPUT STATES | D531 |
| 11. | LAST CHAR. ADDR. BEYOND END OF FONT TABLE ? (13) | D539 |
| 12. | load LAST CHAR. BIT PATTERN | D542 |
| 13. | combine CURR. CHAR. and LAST CHAR. bits | D543 |
| 14. | turn off bits not to be written-turn on at next zero-crossing | D548 |

-continued

| | | |
|---|---|---|
| 15. | CHAR. COUNT ≠ 10 ? (17) | D55E |
| 16. | reset OUTPTNOW bit | D563 |
| 17. | end | D57A |
| 18. | reset to POSITION 0 | D4FC |
| 19. | move CURR. TABLE ADDR. to LAST TABLE ADDR. | D4FE |
| 20. | increment CHAR. COUNT by 1 | D502 |
| 21. | LAST CHAR. ? (28) | D503 |
| 22. | fetch NEXT CHAR. | D507 |
| 23. | compute CHAR. OUTPUT TABLE ADDR. | D519 |
| 24. | is CHAR. an EVEN NUMBER ? (26) | D520 |
| 25. | (11) | |
| 26. | move NEXT TWO DIGITS to HIGH REGISTER | D524 |
| 27. | (11) | |
| 28. | move CHARNPO to CURR. CHAR. | D52A |
| 29. | (11) | |

TABLE I

SINGLE ROW ROM DATA

| ROM ADDRESS | ROM DATA |
|---|---|
| 000000 | 11111000 |
| 000001 | 00000000 |
| 000010 | 10111000 |
| 000011 | 10101000 |
| 000100 | 11100000 |
| 000101 | 11101000 |
| 000110 | 11111000 |
| 000111 | 10000000 |
| 001000 | 11111000 |
| 001001 | 11100000 |
| 001010 | 00000000 |
| 010000 | 10001000 |
| 010001 | 11111000 |
| 010010 | 10101000 |
| 010011 | 10101000 |
| 010100 | 00100000 |
| 010101 | 10101000 |
| 010110 | 10101000 |
| 010111 | 10111000 |
| 011000 | 10101000 |
| 011001 | 10100000 |
| 011010 | 00000000 |
| 100000 | 11111000 |
| 100001 | 00000000 |
| 100010 | 11101000 |
| 100011 | 11111000 |
| 100100 | 11111000 |
| 100101 | 10111000 |
| 100110 | 00111000 |
| 100111 | 11100000 |
| 101000 | 11111000 |
| 101001 | 11111000 |
| 101010 | 00000000 |

TABLE II

FONT TABLE

| | | |
|---|---|---|
| F7B8 | 8000808080808000808000 | CHAR 0–9, null - Position P0 |
| F7C3 | 0180808081818180818100 | CHAR 0–9, null - Position P1 |
| F7CE | A201A2A282A3A282A28200 | CHAR 0–9, null - Position P2 |
| F7D9 | 6322632301226223630300 | CHAR 0–9, null - Position P3 |
| F7E4 | 2240222222222042222200 | CHAR 0–9, null - Position P4 |
| F7EF | 4000004040404000404000 | CHAR 0–9, null - Position P5 |

APPENDIX A

| INSTRUCTION MNEMONIC | HEX VALUE | NAME | DESCRIPTION |
|---|---|---|---|
| AB(L) | A4 | Add Byte (Low) | Adds addressed operand to LACC (8-bit op.) |
| AI(L) | AC | Add Immed. | Adds address field to LACC |

APPENDIX A-continued

| | | | |
|---|---|---|---|
| | | (Low) | (16-bit op.) |
| AR | DN | Add Reg. | Adds N-th register contents to ACC (16-bit op.) |
| A1 | 2E | Add One | Adds 1 to ACC (16-bit op.) |
| B | 24,28,2C | Branch | Branch to LSB (+256, −256, ±0) |
| BAL | 30–33 | Branch And Link | Used to call subroutines (PC to Reg. 0, 1, 2, or 3) |
| BE | 35,39,3D | Branch Equal | Branches if EQ set (See B) |
| BH | 36,3A,3E | Branch High | Branch if EQ and LO are reset (See B) |
| BNE | 34,38,3C | Branch Not Equal | Branch if EQ reset (See B) |
| BNL | 37,3B,3F | Branch Not Low | Branch if LO reset (See B) |
| BR | 20–23 | Branch Reg. | See RTN |
| CB(L) | AO | Compare Byte (Low) | Addressed byte compared to LACC (8-bit op.) |
| CI(L) | A8 | Compare Immed. (Low) | Address field compared to LACC (8-bit op.) |
| CLA | 25 | Clear Acc. | ACC reset to all zeroes (16-bit op.) |
| GI | A9 | Group Immed. | Selects one of 16 register groups (also controls interrupts) |
| IC | 2D | Input Carry | Generate carry into ALU |
| IN | 26 | Input | Read into LACC from addressed device (8-bit op.) |
| J | 0N,1N | Jump | Jump (forward or back) to PC(15–4),N |
| JE | 4N,5N | Jump Equal | Jump if EQ set (See J) |
| JNE | 6N,7N | Jump Not Equal | Jump if EQ reset (See J) |
| LB(L) | A6 | Load Byte (L) | Load addressed byte into LACC (8-bit op.) |
| LI | AE | Load Immed. | Load address field into LACC |
| LN | 98-9F | Load Indirect | Load byte addressed by reg. 8-F into LACC (8-bit op.) |
| LR | EN | Load Register | Load register N into ACC (16-bit op.) |
| LRB | FN | Load Reg./ Bump | Load reg. N into ACC and increment; ACC to Reg. N (N=4–7,C–F) (16-bit op.) |
| LRD | FN | Load Reg./Decr. | Load reg. N into ACC and decrement; ACC to Reg. N (N=0–3,8–B) (16-bit op.) |
| NB(L) | A3 | And Byte (Low) | AND addressed byte into LACC (8-bit op.) |
| NI(L) | AB | And Immed.(Low) | AND address field into LACC (8-bit op.) |
| OB(L) | A7 | Or Byte (Low) | OR addressed byte into LACC (8-bit op.) |
| OI(L) | AF | Or Immed.(Low) | OR address field into LACC (8-bit op.) |
| OUT | 27 | Output | Write LACC to addressed device |
| RTN | 20–23 | Return | Used to return to calling program (See BAL) |
| SB(L) | A2 | Subtract Byte (Low) | Subtract addressed byte from LACC (8-bit op.) |
| SHL | 2B | Shift Left | Shift ACC one bit left (16-bit op.) |
| SHR | 2F | Shift Right | Shift ACC one bit right (16-bit op.) |
| SI(L) | AA | Subtract Immed.(Low) | Subtract address field from LACC (16-bit op.) |
| SR | CN | Subtract Reg. | Subtract reg. N from ACC (16-bit op.) |
| STB(L) | A1 | Store Byte(Low) | Store LACC at address (8-bit op.) |
| STN | B8–BF | Store Indirect | Store LACC at address in Reg. 8–F |
| STR | 8N | Store Reg | Store ACC in Reg. N (16-bit op.) |
| S1 | 2A | Subtract One | Subtract 1 from ACC (16-bit op.) |
| TP | 9N | Test/Preserve | Test N-th bit in LACC (N=0–7) |
| TR | BN | Test/Reset | Test and reset N-th bit in LACC |
| TRA | 29 | Transpose | Interchange HACC and LACC |
| XB(L) | A5 | XOR Byte (Low) | Exclusive-OR addressed byte into LACC (8-bit op.) |
| XI(L) | AD | XOR Immed. | Exclusive-OR address field |

APPENDIX A-continued

| | | |
|---|---|---|
| | (Low) | into LACC (8-bit op.) |

Notes:
ACC (Accumulator) is 16-bit output register from arithmetic-logic unit
LACC signifies herein the low ACC byte; HACC, the high byte
all single byte operations are into low byte
register operations are 16-bit (two-byte)
8-bit operations do not affect HACC
EQ (equal) is a flag which is set:
if ACC=0 after register AND or XOR operations;
if ACC (low byte)=0 after single byte operation;
if a tested bit is 0;
if bits set by OR were all O's;
if input carry = 0;
if compare operands are equal;
if bit shifted out of ACC = 0;
if 8th bit of data during IN or OUT = 0.
LO (low) is a flag which is set: (always reset by IN, OUT, IC)
if ACC bit 16=1 after register operation;
if ACC bit 8=1 after single byte operations;
if logic operation produces all ones in LACC;
if all bits other than tested bit = 0;
if ACC=0 after shift operation;
if compare operand is greater than ACC low byte.

| MACRO MNEMONIC | NAME | DESCRIPTION |
|---|---|---|
| BC | Branch on Carry | Branches if carry is set |
| BCT | Branch on Count | Reg. decremented and branch if not zero result |
| BHA | Branch on High ACC | Used after compare |
| BL | Branch on Low | Branches if LO is set |
| BLA | Branch on Low ACC | See BNC; used after compare |
| BNC | Branch Not Carry | Branches if carry is reset |
| BNLA | Branch on Not Low ACC | See BC; used after compare |
| BNZ | Branch Not Zero | Branches if previous result was not zero |
| BR | Branch via Register | Same as RTN instruction |
| BU | Branch Unconditionally | Same as BAL instruction |
| CIL | Compare Immed. Low | Uses low byte of indicated constant in CI address field |
| DC | Define Constant | Reserves space for constant |
| EXP2 | Express In powers of 2 | Opcode set to binary |
| JC | Jump on Carry | See BC |
| JL | Jump on Low | See BL |
| JNC | Jump on No Carry | See BNC |
| JNH | Jump Not High | See BNH |
| LA | Load Address | Generates sequence LIH, TRA, LIL |
| LBD | Load Byte Double | Bytes at addr. and addr. +1 to ACC |
| LID | Load Immed. Double | Same as LA |
| LIH | Load Immed. High | Uses high byte of constant in LI address field |
| LIL | Load Immed. Low | Uses low byte of constant in LI address field |
| NOP | No Operation | Dummy instruction - skipped |
| RAL | Rotate ACC Left | Generates sequence SHL, IC, A1 |
| SCTI | Set Count Immed. | Generates CLA, LI, STR |
| SHLM | Shift Left Multiple | Shifts specified number of times to left |
| SHRM | Shift Right Multiple | Shifts specified number of times to right |
| SRG | Set Register Group | Same as GI |
| STDB | Store Byte Double | ACC to addr. +1 and addr. |
| TPB | Test & Preserve Bit | Generates sequence LB, TP |
| TRB | Test & Reset Bit | Generates sequence LB, TR, STB |
| TRMB | Test & Reset Multiple Bits | Same as TRB but specifies multiple bits |
| TRMR | Test/Reset Mult. Bits in Reg. | Generates LR, NI, STR |
| TS | Test and Set | Same as OI instruction |
| TSB | Test & Set Byte | Same as TS but byte is specified in addition to bit |
| TSMB | Test & Set Mul- | Same as TS but specifies multiple |

APPENDIX A-continued

| | | |
|---|---|---|
| | tiple Bytes | Bits |
| TSMR | Test & Set Mult. Bits in Reg. | Generates LR, OI, STR |
| LZI | Zero & Load Immed. | Generates CLA, LI |

NOTES:
(Label) DC * causes the present location (*) to be associated with the label.
L and H, in general, are suffixes indicating low or high byte when 16 bit operands are addressed.

APPENDIX B

Conventions Used Flowcharts

1. Each step is numbered.
2. The first statement is "begin" for in-line programs and "enter" for subroutines.
3. In-line programs terminate with "end" subroutines, with "return".
4. A step number in parentheses as a statement or part of the statement indicates a branch to the step.
5. A test statement is followed by a question mark; the question mark is followed by a step number in parentheses indicating the branch to be taken if the test result is true.
6. The call command invokes an off-line subroutine which returns to the following step or statement upon completion.
7. The WHILE (logical statement) ... LOOP command executes the statements enclosed thereby as long as the logical statement is true.
8. Indentations are used to improve readability but have no significance otherwise.

Various modifications to the systems and circuits described and illustrated to explain the concepts and modes of practicing the invention can be made by those of ordinary skill in the art within the principles or scope of the invention as expressed in the following claims.

What is claimed is:

1. In copier/duplicator/printer apparatus for producing copies/duplicates/prints on a photosensitive medium, said copies/duplicates/prints normally comprising a centrally located user-originated image which is surrounded by an unused blank margin, said apparatus including document path means for transporting said copies/duplicates/prints through said apparatus, and a plurality of edge erase light emitting diodes disposed adjacent to and overlapping the document path means for erasing a selective width margin along the normally unused portion of each edge of said copies/duplicates/prints, the improvement comprising:

means for storing apparatus-originated data to be printed in the normally unused margin of said copies/duplicates/prints; and modulator means responsive to said stored data for turning said edge erase light emitting diodes on and off to cause said data to be printed in the normally unused margin of said copies/duplicates/prints;

said modulator means including:

register means for controlling said edge erase light emitting diodes, said register means having a plurality of stages, each stage controlling a separate one of said light emitting diodes; and controller means responsive to said stored data for supplying a timed sequence of register settings to said register means to cause said stored data to be printed in the margin of said copies/duplicates/prints.

2. The invention claimed in claim 1 wherein said controller means includes:

sequencing means for supplying timed control signals; and conversion means responsive to said stored data for supplying said sequence of register settings in response to said timed control signals.

3. The invention claimed in claim 1 wherein said controller means includes a programmable microcomputer.

* * * * *